US011217128B2

(12) United States Patent
Jung et al.

(10) Patent No.: US 11,217,128 B2
(45) Date of Patent: Jan. 4, 2022

(54) DISPLAY PANEL AND METHOD FOR DETECTING CRACKS IN DISPLAY PANEL

(71) Applicant: SAMSUNG DISPLAY CO., LTD., Yongin-si (KR)

(72) Inventors: Kwangchul Jung, Seoul (KR); Jaeyoon Jung, Seoul (KR); Joungpyo Park, Yeosu-si (KR); Boogyo Shin, Asan-si (KR); Hyunsuk Yang, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/854,260

(22) Filed: Dec. 26, 2017

(65) Prior Publication Data

US 2018/0182274 A1 Jun. 28, 2018

(30) Foreign Application Priority Data

Dec. 27, 2016 (KR) ..... 10-2016-0180233

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/0426* (2013.01); *G09G 2330/10* (2013.01); *G09G 2330/12* (2013.01); *G09G 2360/148* (2013.01)

(58) Field of Classification Search
CPC .. G09G 3/006; G09G 3/20; G09G 2300/0426; G09G 2330/10; G09G 2330/12; G09G 2360/148
See application file for complete search history.

(56) References Cited

U.S. PATENT DOCUMENTS 6,246,074 B1 * 6/2001 Kim ..... G01R 31/58 257/48
9,495,903 B2 11/2016 Kwon et al.
9,747,831 B2 8/2017 Park et al.
2003/0184334 A1 * 10/2003 Matsunaga ..... G09G 3/006 324/760.02

(Continued)

FOREIGN PATENT DOCUMENTS

KR 1020090105027 A 10/2009
KR 1020130136806 A 12/2013
KR 1020160060237 A 5/2016

*Primary Examiner* — Kent W Chang
*Assistant Examiner* — Sujit Shah
(74) *Attorney, Agent, or Firm* — Cantor Colburn LLP

(57) ABSTRACT

A display panel includes: a substrate including a display area and a non-display area around the display area; a plurality of scan lines and a plurality of data lines crossing each other on the substrate at the display area; a plurality of pixels connected to the plurality of scan lines and the plurality of data lines; and a test circuit portion on the substrate at the non-display area, the test circuit portion connected to the plurality of data lines. The test circuit portion includes: a lighting test signal line which applies a lighting signal to each of the plurality of data lines; and a crack detection circuit line connected between the plurality of data lines and the lighting test signal line. The crack detection circuit line includes a plurality of signal lines connected to different data lines among the plurality of data lines.

18 Claims, 6 Drawing Sheets

(56) References Cited

U.S. PATENT DOCUMENTS

| | | | | |
|---|---|---|---|---|
| 2004/0046920 | A1* | 3/2004 | Hayata | G02F 1/1345 349/149 |
| 2004/0207772 | A1* | 10/2004 | Tomita | G09G 3/006 349/42 |
| 2006/0285053 | A1* | 12/2006 | Jeoung | G02F 1/136259 349/149 |
| 2008/0117345 | A1* | 5/2008 | Ishii | G02F 1/136204 349/40 |
| 2010/0006838 | A1* | 1/2010 | Yoshida | G09G 3/006 257/48 |
| 2011/0018571 | A1* | 1/2011 | Kim | G02F 1/1345 324/760.02 |
| 2011/0080173 | A1* | 4/2011 | Kim | G09G 3/006 324/403 |
| 2011/0134089 | A1* | 6/2011 | Ozeki | G02F 1/136259 345/205 |
| 2014/0176844 | A1* | 6/2014 | Yanagisawa | G09G 3/006 349/43 |
| 2014/0217373 | A1* | 8/2014 | Youn | H01L 23/4985 257/40 |
| 2016/0372017 | A1* | 12/2016 | Byun | G09G 3/006 |
| 2017/0123249 | A1* | 5/2017 | Yoshida | G02F 1/13452 |

* cited by examiner

FIG. 5

| | Detecting | | | | Decision |
|---|---|---|---|---|---|
| | 1st Line | 2nd Line | 3rd Line | 4th Line | |
| Case 1 | ○ | ○ | ○ | ○ | Ok |
| Case 2 | ○ | ○ | ○ | × | Ng |
| Case 3 | ○ | ○ | × | ○ | Ng |
| Case 4 | ○ | ○ | × | × | Ng |
| Case 5 | ○ | × | ○ | ○ | Ng |
| Case 6 | ○ | × | ○ | × | Ng |
| Case 7 | ○ | × | × | ○ | Ng |
| Case 8 | ○ | × | × | × | Ng |
| Case 9 | × | ○ | ○ | ○ | Ng |
| Case 10 | × | ○ | ○ | × | Ng |
| Case 11 | × | ○ | × | ○ | Ng |
| Case 12 | × | ○ | × | × | Ng |
| Case 13 | × | × | ○ | ○ | Ng |
| Case 14 | × | × | ○ | × | Ng |
| Case 15 | × | × | × | ○ | Ng |
| Case 16 | × | × | × | × | Ng |

FIG. 6

| | Detecting | | | | Decision |
|---|---|---|---|---|---|
| | 1st Line | 2nd Line | 3rd Line | 4th Line | |
| Case 1 | ○ | ○ | ○ | ○ | Ok |
| Case 2 | ○ | ○ | ○ | × | Ok |
| Case 3 | ○ | ○ | × | ○ | Ok |
| Case 4 | ○ | ○ | × | × | Ng |
| Case 5 | ○ | × | ○ | ○ | Ok |
| Case 6 | ○ | × | ○ | × | Ok |
| Case 7 | ○ | × | × | ○ | Ok |
| Case 8 | ○ | × | × | × | Ng |
| Case 9 | × | ○ | ○ | ○ | Ok |
| Case 10 | × | ○ | ○ | × | Ok |
| Case 11 | × | ○ | × | ○ | Ok |
| Case 12 | × | ○ | × | × | Ng |
| Case 13 | × | × | ○ | ○ | Ok |
| Case 14 | × | × | ○ | × | Ok |
| Case 15 | × | × | × | ○ | Ok |
| Case 16 | × | × | × | × | Ng |

DISPLAY PANEL AND METHOD FOR DETECTING CRACKS IN DISPLAY PANEL

This application claims priority to Korean Patent Application No. 10-2016-0180233, filed on Dec. 27, 2016, and all the benefits accruing therefrom under 35 U.S.C. § 119, the content of which in its entirety is herein incorporated by reference.

BACKGROUND

1. Field

Embodiments of the invention relate to a display panel and a method of detecting cracks in the display panel, and more particularly, to a display panel and a method of detecting cracks in the display panel with improved detection capability and improved accuracy.

2. Discussion of Related Art

A display panel typically includes a plurality of pixels arranged in an area defined by a black matrix or a pixel defining layer. The display panel may be classified as a liquid crystal display ("LCD") panel, a plasma display panel ("PDP"), an organic light emitting diode ("OLED") display panel or the like, according to a light emitting scheme thereof.

The display panel generally has a quadrangular shape. The display panel may include a display area in which a plurality of pixels for displaying images are arranged and a non-display area at an edge of the display area.

A plurality of gate lines, a plurality of data lines and a plurality of pixels may be disposed at the display area of the display panel, and each pixel may be driven by various signals and a driving voltage applied through various signal wirings and a power wiring arranged at the non-display area of the display panel.

In a display panel, a test circuit for testing each pixel, a crack detection circuit portion for detecting breakage or cracks of the display panel, and the like may also be disposed at the non-display area of the display panel.

In the case where the display panel has defects such as breakage or cracks, moisture permeation may occur, which may adversely affect the normal operation or performance of the display panel.

In a conventional display panel, a detection circuit may be disposed at the non-display area, and when a crack occurs and the detection circuit is thereby disconnected, the crack in the display panel may be detected through a lighting test.

SUMMARY

In a display panel including a detection circuit, when a line width of the detection circuit is reduced or a length thereof is increased to improve the detection capability, the accuracy of the defect detection may be degraded. For example, even if no crack has actually occurred in the display panel, it may be determined that a crack has occurred in the display panel if the detection circuit is disconnected by particles or the like.

Embodiments of the invention are directed to a display panel including a defect detection circuit for detecting display panel cracks with improved detection capability and improved accuracy, and to a method of detecting cracks in the display panel.

According to an exemplary embodiment, a display panel includes: a substrate including a display area and a non-display area around the display area; a plurality of scan lines on the substrate at the display area, a plurality of data lines on the substrate at the display area and crossing the plurality of scan lines; a plurality of pixels connected to the plurality of scan lines and the plurality of data lines; and a test circuit portion on the substrate at the non-display area, where the test circuit portion is connected to the plurality of data lines. In such an embodiment, the test circuit portion includes: a lighting test signal line which applies a lighting signal to each of the plurality of data lines; and a crack detection circuit line connected between the plurality of data lines and the lighting test signal line, and the crack detection circuit line includes a plurality of signal lines connected to different data lines among the plurality of data lines.

In an exemplary embodiment, each of the plurality of signal lines may include: a first portion extending from an end portion of a corresponding data line of the different data lines along an edge of the display area; and a second portion extending from the first portion in a direction opposite to a direction in which the first portion extends, and connected to the lighting test signal line.

In an exemplary embodiment, the plurality of signal lines may be disposed adjacent to each other.

In an exemplary embodiment, the plurality of signal lines may be sequentially arranged from an inner portion of the substrate to an outer portion of the substrate.

In an exemplary embodiment, each of the plurality of signal lines may be connected to at least one of the different data lines.

In an exemplary embodiment, the plurality of signal lines may include: first, second, third and fourth signal lines; and fifth, sixth, seventh and eighth signal lines, where the first portion of the first, second, third and fourth signal lines may extend in a clockwise direction along a first edge of the display area, and the first portion of the fifth, sixth, seventh and eighth signal lines may extend in a counterclockwise direction along a second edge of the display area.

In an exemplary embodiment, the first, second, third and fourth signal lines may be disposed adjacent to the fifth, sixth, seventh and eighth signal lines at an area of the non-display area.

In an exemplary embodiment, the first, second, third and fourth signal lines may be disposed alternately with the fifth, sixth, seventh and eighth signal lines in a zigzag manner at an arbitrary area of the non-display area.

In an exemplary embodiment, the pixel may include: a first pixel which displays a red color; a second pixel which displays a green color; and a third pixel which displays a blue color.

In an exemplary embodiment, each of the first, second and third pixels may be provided in plural, and the data line may include: a first data line connected to a plurality of first pixels; a second data line connected to a plurality of second pixels; and a third data line connected to a plurality of third pixels.

In an exemplary embodiment, the crack detection circuit line may be disposed between the second data line and the lighting test signal line.

In an exemplary embodiment, the test circuit portion may further include a transistor which electrically connects the lighting test signal line to the data line in response to a control signal.

According to an exemplary embodiment, a method of detecting cracks in a display panel, which includes a display area, in which pixel columns connected to data lines are disposed, and a non-display area around the display area, includes: applying a lighting signal through a plurality of signal lines connected to different data lines of the data lines; detecting whether or not pixel columns connected to the different data lines emits light; and determining whether or not a crack has occurred based on a result of the detecting whether or not the pixel columns connected to the different data lines emit light.

In an exemplary embodiment, each of the plurality of signal lines may include: a first portion extending from an end portion of a corresponding data line of the different data lines along an edge of the display area; and a second portion extending from the first portion in a direction opposite to a direction in which the first portion extends.

In an exemplary embodiment, the plurality of signal lines may be sequentially arranged from an inner portion of a substrate to an outer portion of the substrate.

In an exemplary embodiment, the determining whether or not the crack has occurred may include determining that a crack has occurred when at least one of the pixel columns connected to the different data lines emits light.

In an exemplary embodiment, the determining whether or not the crack has occurred may include determining that no crack has occurred when: a pixel column of the pixel columns connected to the different data lines emits light; another pixel column of the pixel columns connected to the different data lines does not emit light; and a signal line connected to the another pixel column, which does not emit light, is disposed more outwardly than a signal line connected to the pixel column which emits light.

In an exemplary embodiment, the determining whether or not the crack has occurred may include determining that a crack has occurred when at least one of the pixel columns connected to the different data lines does not emit light.

In an exemplary embodiment, the determining whether or not the crack has occurred may include determining that no crack has occurred when: a pixel column of the pixel columns connected to the different data lines emits light; another pixel column of the pixel columns connected to the different data lines does not emit light; and a signal line connected to the pixel column, which emits light, is disposed more outwardly than a signal line connected to the another pixel column which does not emit light.

BRIEF DESCRIPTION OF THE DRAWINGS

The above and other features of the invention will become more apparent by describing in detail exemplary embodiments thereof with reference to the accompanying drawings, in which:

FIG. 5 is a table for explaining a method of detecting cracks in the display panel according to an exemplary embodiment; and FIG. 6 is a table for explaining a method of detecting cracks in the display panel according to an exemplary embodiment.

DETAILED DESCRIPTION

Figure 1:
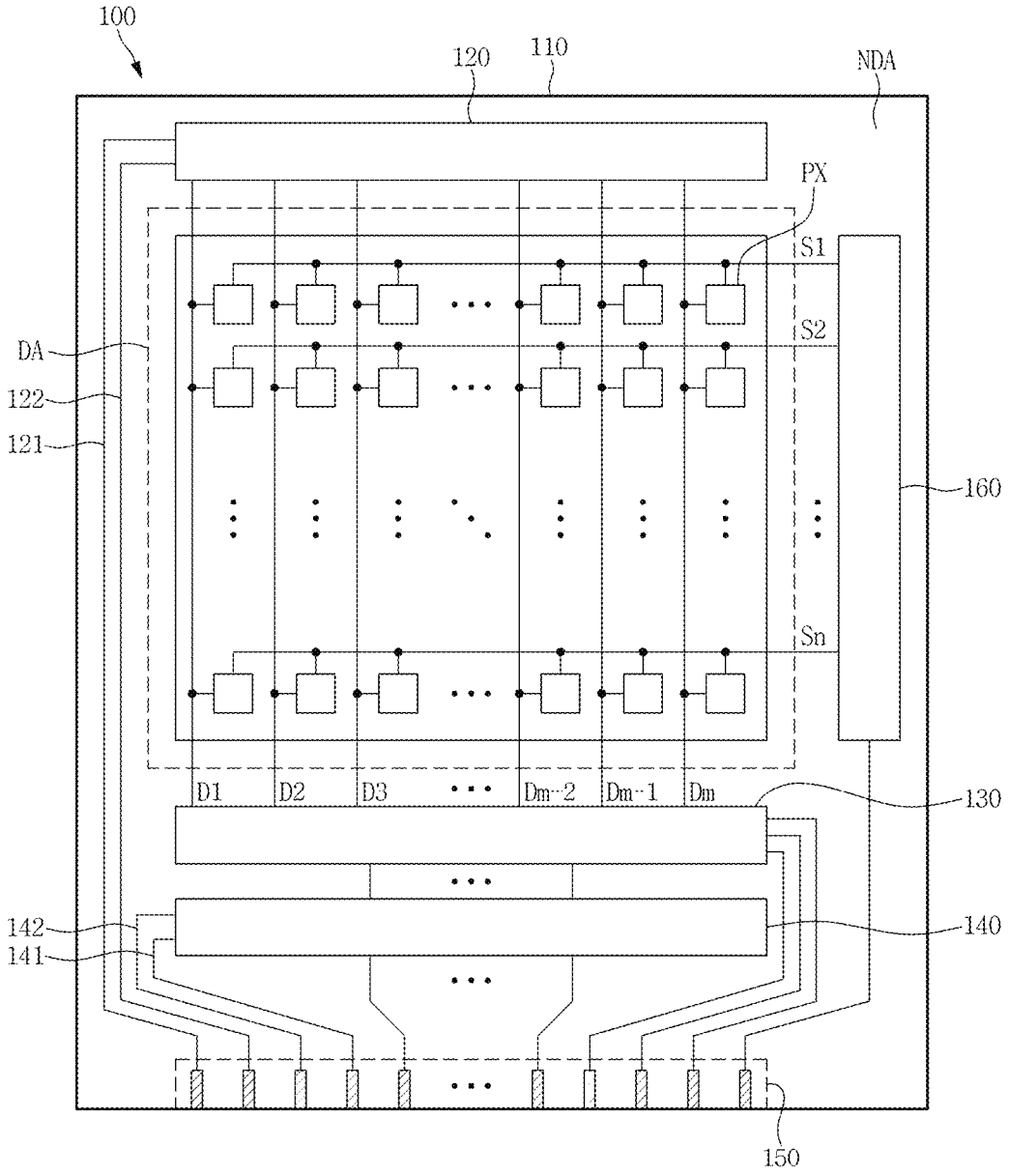
FIG. 1 is a plan view schematically illustrating a display panel according to an exemplary embodiment.

Exemplary embodiments will now be described more fully hereinafter with reference to the accompanying drawings. Although the invention may be modified in various manners and have several exemplary embodiments, exemplary embodiments are illustrated in the accompanying drawings and will be mainly described in the specification. However, the scope of the invention is not limited to the exemplary embodiments and should be construed as including all the changes, equivalents and substitutions included in the spirit and scope of the invention.

In the drawings, thicknesses of a plurality of layers and areas are illustrated in an enlarged manner for clarity and ease of description thereof. When a layer, area, or plate is referred to as being "on" another layer, area, or plate, it may be directly on the other layer, area, or plate, or intervening layers, areas, or plates may be therebetween. Conversely, when a layer, area, or plate is referred to as being "directly on" another layer, area, or plate, intervening layers, areas, or plates may be absent therebetween. Further when a layer, area, or plate is referred to as being "below" another layer, area, or plate, it may be directly below the other layer, area, or plate, or intervening layers, areas, or plates may be therebetween. Conversely, when a layer, area, or plate is referred to as being "directly below" another layer, area, or plate, intervening layers, areas, or plates may be absent therebetween.

The spatially relative terms "below", "beneath", "lower", "above", "upper" and the like may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in the other direction and thus the spatially relative terms may be interpreted differently depending on the orientations.

Throughout the specification, when an element is referred to as being "connected" to another element, the element is "directly connected" to the other element, or "electrically connected" to the other element with one or more intervening elements interposed therebetween. It will be further understood that the terms "comprises," "including," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" may be termed likewise without departing from the teachings herein.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the specification.

Some of the parts which are not associated with the description may not be provided in order to specifically describe embodiments of the invention and like reference numerals refer to like elements throughout the specification.

Herein, a one sheet test (or a sheet unit test) is a test method in which a lighting test, a leakage current test, an aging test or the like is performed for each sheet unit of a mother substrate in a display device.

Herein, a lighting test may be a test for detecting common pixel defects, circuit damages, or the like of a display panel. In exemplary embodiments, the lighting test includes a module crack detection test for detecting damages that occur at a non-display area of the display panel.

Hereinafter, exemplary embodiments of the present invention will be described with reference to the accompanying drawings.

FIG. 1 is a plan view schematically illustrating a display panel according to an exemplary embodiment.

Referring to FIG. 1, an exemplary embodiment of a display panel 100 includes a substrate 110 including a display area DA and a non-display area NDA around the display area DA, a first test circuit portion 120, a switch portion 130, a second test circuit portion 140, a pad portion 150, a scan driver 160, and the like.

Hereinafter, for convenience of description, exemplary embodiments where the display panel 100 is an organic light emitting diode ("OLED") display panel will be described in detail. However, exemplary embodiments are not limited thereto, and alternatively, the display panel 100 may be a liquid crystal display ("LCD") panel, for example.

In an exemplary embodiment, the display panel 100 may include a plurality of scan lines S1, S2 and Sn, a plurality of data lines D1, D2, D3, Dm−2, Dm−1 and Dm, and a plurality of pixels PX connected to the scan lines S1, S2 and Sn and the data lines D1, D2, D3, Dm−2, Dm−1 and Dm. In an exemplary embodiment, the pixels PX may be arranged at areas where the scan lines S1, S2 and Sn cross the data lines D1, D2, D3, Dm−2, Dm−1 and Dm, which are disposed on the substrate 110 at the display area DA, which are disposed on the substrate 110 at the display area DA.

The pixels PX may receive a data signal applied from the data lines D1, D2, D3, Dm−2, Dm−1 and Dm when scan signals are applied from the scan lines S1, S2 and Sn, and may emit a light with a luminance corresponding to the data signal.

Hereinafter, for convenience of description, a plurality of pixels PX connected to a data line of the data lines D1, D2, D3, Dm−2, Dm−1 and Dm are collectively referred to as a pixel column.

The display panel 100 may include a first test circuit portion 120, a switch portion 130, a second test circuit portion 140, a pad portion 150, a scan driver 160 and the like, which are disposed on the substrate 110 at the non-display area NDA.

The first test circuit portion 120 is connected to the data lines D1, D2, D3, Dm−2, Dm−1 and Dm and the pad portion 150 to transmit a first lighting signal to each of the data lines D1, D2, D3, Dm−2, Dm−1 and Dm in response to a first control signal.

In one exemplary embodiment, for example, the first test circuit portion 120 may transmit the first lighting signal to each of the data lines in a one sheet test step for the display panel 100. The first lighting signal may be transmitted through a first lighting signal line 121, and the first control signal may be transmitted through a first control signal line 122.

In an exemplary embodiment, where the display panel 100 is combined with other devices (for example, a driver, etc.) to form a display device, the first test circuit portion 120 may apply a pre-charge voltage to each of the data lines D1, D2, D3, Dm−2, Dm−1 and Dm for a predetermined period of time. The pre-charge voltage is a voltage applied during a period in which the data signal is not input from the outside, to quickly charge each data line with a voltage of the data signal.

The switch portion 130 is connected between the second test circuit portion 140 and the data lines D1, D2, D3, Dm−2, Dm−1 and Dm, and distributes signals (e.g., the lighting signal or the data signal) applied from the second test circuit portion 140 or the pad portion 150 to output the signals to each of the data lines D1, D2, D3, Dm−2, Dm−1 and Dm. In one exemplary embodiment, for example, the switch portion 130 includes a demultiplexer (or a data distribution circuit).

The second test circuit portion 140 is connected between the switch portion 130 and the pad portion 150 and transmits a second lighting signal to each of the data lines D1, D2, D3, Dm−2, Dm−1 and Dm in response to a second control signal. The second lighting signal may be transmitted through a second lighting signal line 141, and the second control signal may be transmitted through a second control signal line 142.

In one exemplary embodiment, for example, the second test circuit portion 140 includes a plurality of transistors (not illustrated) connected between the data lines and an input line to which the second lighting signal is input.

In an exemplary embodiment, the second test circuit portion 140 is in an off-state during an actual driving period after the lighting test is completed. In such an embodiment, the second test circuit portion 140 is in an off-state by a bias signal applied from the pad portion 150 after a driving integrated circuit ("IC") is mounted on the display panel 100.

The second test circuit portion 140 may be referred to as a pre-test circuit portion because the second test circuit portion 140 is used only before the actual driving period of the display panel. Likewise, the second lighting signal and the second control signal may be referred to as a pre-lighting test signal and a pre-test control signal, respectively.

The pad portion 150 may include a plurality of pads for transmitting various driving power sources and driving signals applied from an outside to an inside of the panel. Herein, the various driving power sources and the driving signals may include lighting signals, control signals, and the like.

The scan driver 160 receives a scan driving control signal through the pad portion 150 to generate a scan signal and applies the generated scan signal sequentially to scan lines S1, S2, . . . , and Sn.

The scan driving control signal may include a start pulse, a clock signal, and the like. The scan driver may include a shift register which sequentially generates scan signals based on the start pulse and the clock signals.

Figure 2:
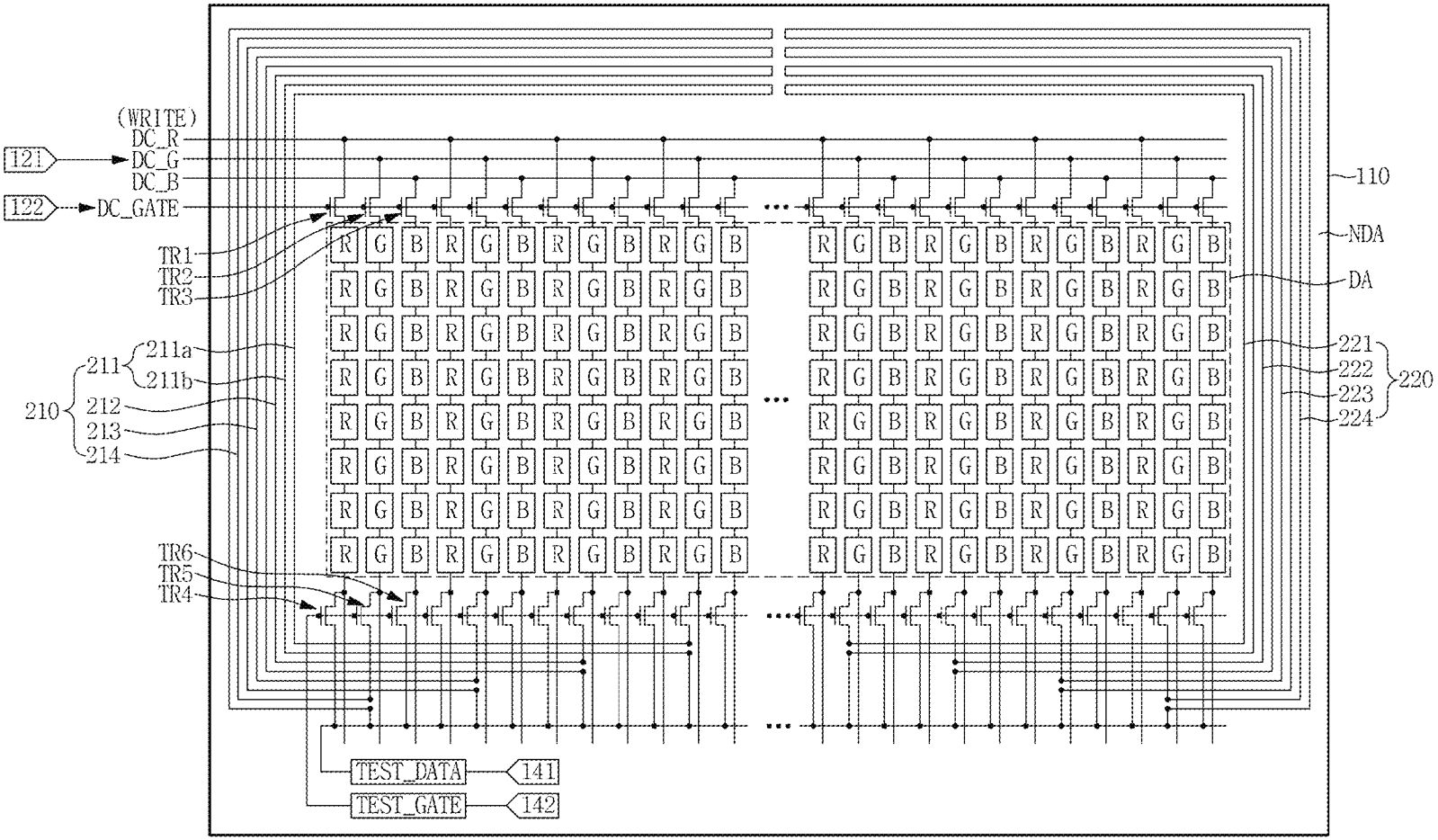
FIG. 2 is a plan view schematically illustrating a display area, a first test circuit portion and a second test circuit portion of FIG. 1.
Figure 3:
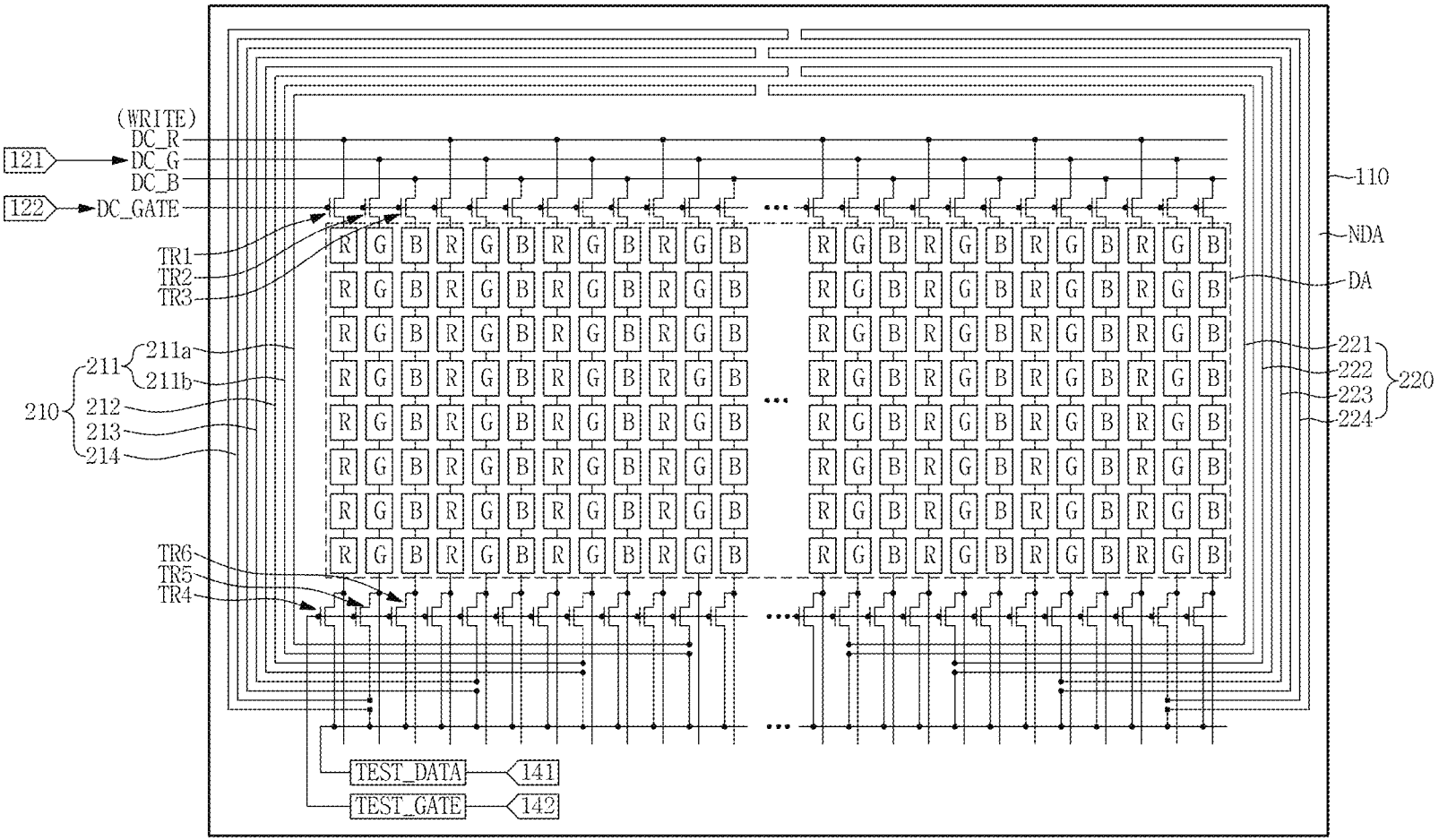
FIG. 3 is a plan view schematically illustrating a display area, a first test circuit portion and a second test circuit portion according to an alternative exemplary embodiment.

FIG. 2 is a plan view schematically illustrating the display area, the first test circuit portion and the second test circuit portion of FIG. 1, and FIG. 3 is a plan view schematically illustrating a display area, a first test circuit portion and a second test circuit portion according to an alternative exemplary embodiment.

Referring to FIGS. 1 and 2, in an exemplary embodiment, the pixels PX may include a first pixel R for displaying red, a second pixel G for displaying green and a third pixel B for displaying blue. Hereinafter, for convenience of explanation, a plurality of first pixels R connected to one data line are referred to as a first pixel column, a plurality of second pixels G connected to one data line are referred to as a second pixel column, and a plurality of third pixels B connected to one data line are referred to as a third pixel row.

For convenience of explanation, a data line connected to the plurality of first pixels R is referred to as a first data line, a data line connected to the plurality of second pixels G is referred to as a second data line, and a data line connected to the plurality of third pixels B is referred to as a third data line.

For reference, sub-pixels, each of which displays red, green, blue, or the like are generally referred to as one pixel. However, for convenience of explanation, herein, each of the sub-pixels for displaying red, green, blue, or the like is referred to as a pixel.

In an exemplary embodiment, the first pixel column, the second pixel column and the third pixel column are sequentially and alternately arranged in the order of the first pixel column, the second pixel column and the third pixel column from a left side to a right side of the substrate 110, but exemplary embodiments are not limited thereto. In an exemplary embodiment, the first pixel column, the second pixel column and the third pixel column may be sequentially and alternately arranged in the order of the first pixel column, the third pixel column and the second pixel column.

The first test circuit portion 120 includes a first wiring DC_R to which a voltage corresponding to the first pixel column (a pixel column R) is applied, a first transistor TR1 connected between the first wiring DC_R and the first pixel column, a second wiring DC_G to which a voltage corresponding to the second pixel column (a pixel column G) is applied, a second transistor TR2 connected between the second wiring DC_G and the second pixel column, a third wiring DC_B to which a voltage corresponding to the third pixel column (a pixel column B) is applied, a third transistor TR3 connected between the third wiring DC_B and the third pixel column, and a first control signal line DC_GATE to which the first control signal for turning on the first, second and third transistors TR1, TR2 and TR3 is applied.

In an exemplary embodiment, the first, second and third transistors TR1, TR2 and TR3 may be p-type metal-oxide-semiconductor ("PMOS") transistors, but exemplary embodiments are not limited thereto. In an alternative exemplary embodiment, the first, second and third transistors TR1, TR2 and TR3 may be n-type metal-oxide-semiconductor ("NMOS") transistors or may be different types of transistor from each other.

A voltage applied through the first, second and third wirings DC_R, DC_G and DC_B is a lighting signal voltage for a lighting test of the first, second and third pixel columns. In one exemplary embodiment, for example, in the step of the one sheet test for the display panel 100, the voltage applied through the first, second and third wirings DC_R, DC_G and DC_B may be about zero (0) volt (V). In such an embodiment, in the step of the module test (the lighting test which is performed in a state where the driving IC is mounted on the display panel), the voltage applied through the first, second and third wirings DC_R, DC_G and DC_B may be about 6.4 V.

In an exemplary embodiment, as described above, the voltages applied through the first, second and third wirings DC_R, DC_G and DC_B after the lighting test is completed, that is, when the display panel 100 is normally driven in the display device, may correspond to a pre-charge voltage for driving each of the pixels R, G and B, and voltage levels of the respective voltages may be equal to or different from each other depending on the light emission characteristics of the pixel.

The second test circuit portion 140 includes a lighting test signal line TEST_DATA to which the second lighting signal is applied, a fourth transistor TR4 connected between the lighting test signal line TEST_DATA and the first pixel column, a fifth transistor TR5 connected between the lighting test signal line TEST_DATA and the second pixel column, a sixth transistor TR6 connected between the lighting test signal line TEST_DATA and the third pixel column, and a second control signal line TEST_GATE to which the second control signal to turn on the fourth, fifth and sixth transistors is applied.

In an exemplary embodiment, the fourth, fifth and sixth transistors TR4, TR5 and TR6 may be PMOS transistors, but exemplary embodiments are not limited thereto. In an alternative exemplary embodiment, the fourth, fifth and sixth transistors TR4, TR5 and TR6 may be NMOS transistors or may be different types of transistor from each other.

In an exemplary embodiment, the second test circuit portion 140 may include crack detection circuit lines 210 and 220 disposed at the non-display area NDA and extending along an edge of the display area DA.

The crack detection circuit lines 210 and 220 may be connected between the lighting test signal line TEST_DATA and the fourth, fifth and sixth transistors TR4, TR5 and TR6. In such an embodiment, the crack detection circuit lines 210 and 220 may be disposed between the lighting test signal line TEST_DATA and the fifth transistors TR5, but not being limited thereto.

In an exemplary embodiment, the crack detection circuit lines 210 and 220 may be arranged in a bilaterally symmetrical manner at the non-display area NDA of the substrate 110. A crack detection circuit line disposed at a left side portion of the non-display area NDA of the substrate 110 is denoted by reference numeral 210, and a crack detection circuit line disposed at a right side portion of the non-display area NDA of the substrate 110 is denoted by reference numeral 220.

Hereinafter, for conciseness, the descriptions are provided with respect to the crack detection circuit line 210 at the left side portion of the non-display area NDA of the substrate 110, which are substantially the same as the crack detection circuit line 220 at the right side portion of the non-display area NDA of the substrate 110.

The crack detection circuit line 210 may include first, second, third and fourth signal lines 211, 212, 213 and 214 spaced apart from each other. In an exemplary embodiment, as shown in FIG. 2, the crack detection circuit line 210 includes four signal lines spaced apart from each other, but exemplary embodiments are not limited thereto. In an exemplary embodiment, the crack detection circuit line 210 may include a plurality of signal lines spaced apart from each other.

Each of the first, second, third and fourth signal lines 211, 212, 213 and 214 may be connected between the lighting test signal line TEST_DATA and respective different ones of the fifth transistors TR5.

The first signal line 211 may include a first portion 211*a* which extends from an end portion of the data line along an edge of the display area DA in a clockwise direction and a second portion 211*b* which turns around from the first portion 211*a* to extend in a counterclockwise direction and connected to the lighting test signal line TEST_DATA.

Similarly to the first signal line 211, each of the second, third and fourth signal lines 212, 213 and 214 may include a first portion which extends from an end portion of the data line along an edge of the display area DA in a clockwise direction and a second portion which turns around from the first portion to extend in a counterclockwise direction and connected to the lighting test signal line TEST_DATA.

In such an embodiment, the first, second, third and fourth signal lines 211, 212, 213 and 214 may be sequentially arranged in the order of the first, second, third and fourth signal lines 211, 212, 213 and 214 from an inner portion to an outer portion of the non-display area NDA.

Each of the first, second, third and fourth signal lines 211, 212, 213 and 214 has a resistance value, and the resistance value of each of the first, second, third and fourth signal lines 211, 212, 213 and 214 may vary (or increase) due to damages (e.g., cracks) that occur in a corresponding area.

In an exemplary embodiment, whether or not a crack has occurred in the left side portion of non-display area NDA of the substrate 110 may be detected based on a change in resistance of the first, second, third and fourth signal lines 211, 212, 213 and 214 due to the crack.

In such an embodiment, the crack detection circuit line 220 at the right side portion of the non-display area NDA of the substrate 110 includes the fifth, sixth, seventh and eighth signal lines 221, 222, 223 and 224. Accordingly, whether or not a crack has occurred in the right non-display area NDA of the substrate 110 may be detected based on a change in resistance of the fifth, sixth, seventh and eighth signal lines 221, 222, 223 and 224 due to the crack.

Each of the fifth, sixth, seventh and eighth signal lines 221, 222, 223 and 224 may include a first portion which extends from an end portion of the data line along an edge of the display area DA in a counterclockwise direction and a second portion which turns around from the first portion to extend in a clockwise direction and connected to the lighting test signal line TEST_DATA.

Referring to FIG. 2, the first, second, third and fourth signal lines 211, 212, 213 and 214 may be disposed adjacent to the fifth, sixth, seventh and eighth signal lines 221, 222, 223 and 224 at an arbitrary area on the non-display area NDA. In one exemplary embodiment, for example, as shown in FIG. 2, the first, second, third and fourth signal lines 211, 212, 213 and 214 disposed adjacent to the fifth, sixth, seventh and eighth signal lines 221, 222, 223 and 224 at a central portion of an upper portion of the non-display area NDA, but exemplary embodiments are not limited thereto.

In an alternative exemplary embodiment, as shown in FIG. 3, the first, second, third and fourth signal lines 211, 212, 213 and 214 may be arranged alternately with the fifth, sixth, seventh and eighth signal lines 221, 222, 223 and 224 in a zigzag manner, at an arbitrary area on the non-display area NDA. In one exemplary embodiment, for example, as shown in FIG. 3, the first, second, third and fourth signal lines 211, 212, 213 and 214 and the fifth, sixth, seventh and eighth signal lines 221, 222, 223 and 224 are alternately disposed in a zigzag manner at a central portion of an upper portion of the non-display area NDA, but exemplary embodiments are not limited thereto.

As the first, second, third and fourth signal lines 211, 212, 213 and 214 and the fifth, sixth, seventh and eighth signal lines 221, 222, 223 and 224 defines a structure in which end portions thereof are staggered in a zigzag manner as illustrated in FIG. 3, whether or not a crack has occurred may be detected across an entire area of the non-display area NDA.

In an exemplary embodiment, as shown in FIG. 2, the first, second, third and fourth signal lines 211, 212, 213 and 214 connected between the lighting test signal line TEST_DATA and respective different ones of the fifth transistors TR5, but exemplary embodiments are not limited thereto. In an alternative exemplary embodiment, the first, second, third and fourth signal lines 211, 212, 213 and 214 may be connected between the lighting test signal line TEST_DATA and respective different ones of the fourth transistors TR4, or between the lighting test signal line TEST_DATA and respective different ones of the sixth transistors TR6. In another alternative exemplary embodiment, the first, second, third and fourth signal lines 211, 212, 213 and 214 may be connected to different transistors TR4, TR5 and TR6.

According to an exemplary embodiment, the first, second, third and fourth signal lines 211, 212, 213 and 214 may be connected between the lighting test signal line TEST_DATA and respective different ones of the fifth transistors TR5. The fifth transistor TR5 is connected to a data line corresponding to the second pixel column (the pixel column G) which displays green.

The red, green and blue pixels R, G and B may each have different light emission characteristics, and the first, second, third and fourth signal lines 211, 212, 213 and 214 may be connected to a data line corresponding to the second pixel column in which the green pixel G having a relatively high luminance is disposed. Based on the visibility of the green pixel, the damages of the display panel may be more effectively detected.

Figure 4:
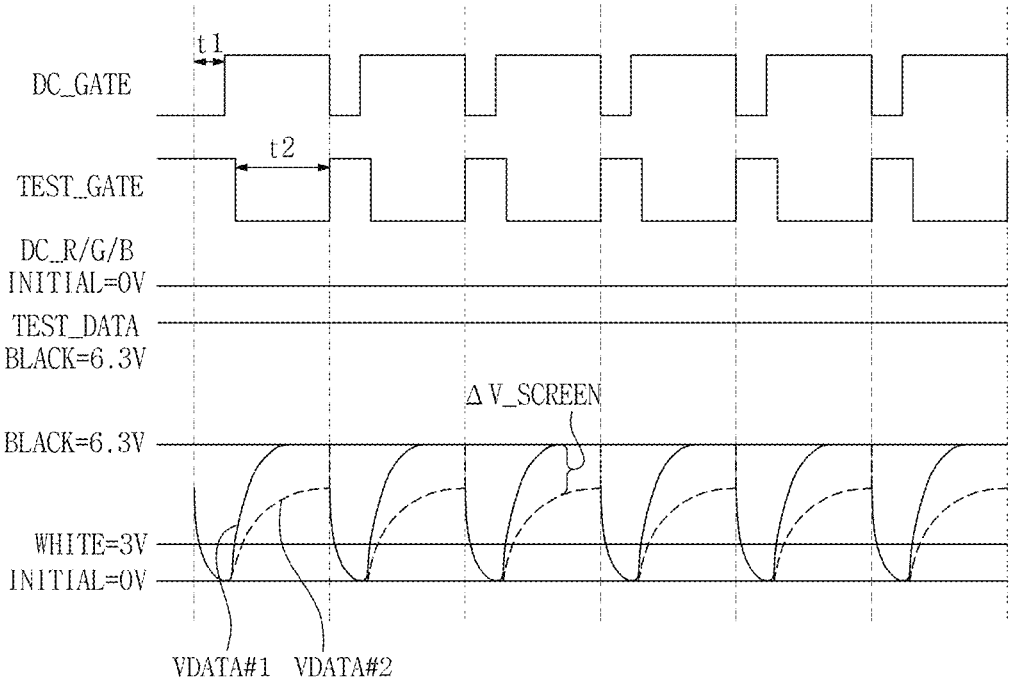
FIG. 4 is a waveform diagram illustrating various signals in FIG. 2.

FIG. 4 is a waveform diagram illustrating various signals in FIG. 2. FIG. 4 shows waveforms of pixels and various signals applied to the first signal line 211 and the second signal line 212. The waveform of the first signal line 211 corresponds to a case where no crack has occurred and the waveform of the second signal line 212 corresponds to a case where a crack has occurred. A y-axis of the waveform represents voltage level of each signal, and an x-axis of the waveform represents time. Each time divided by dotted lines on the x-axis corresponds to the time allocated to each pixel on a pixel column.

Referring to FIGS. 1, 2, 3 and 4, a voltage applied from the outside to the first, second and third wirings DC_R, DC_G and DC_B of the first test circuit portion 120 is a direct-current ("DC") voltage of about zero (0) V, and a voltage applied from the outside to the lighting test signal line TEST_DATA of the second test circuit portion 140 may be a DC voltage of about 6.3 V.

However, exemplary embodiments are not limited thereto, and the voltage applied to the first, second and third wirings DC_R, DC_G and DC_B and the voltage applied to the lighting test signal line TEST_DATA may have various voltage levels in relation to the lighting test conditions.

The first control signal line DC_GATE may provide a low level value in a first period t1 and a high level value in other periods. Accordingly, the first test circuit portion 120 transmits the voltage applied to the first, second and third wirings DC_R, DC_G and DC_B to the data line in the first period t1.

In one exemplary embodiment, for example, the first, second and third transistors in the first test circuit portion 120 are turned on during the first period t1, and electrically connects the first, second and third wirings DC_R, DC_G and DC_B to each corresponding one of the data lines. That is, the first test circuit portion 120 may initialize data of the data line in the first period t1.

The second control signal line TEST_GATE may provide a low level value in a second period t2 and a high level value in other periods. Accordingly, the second test circuit portion 140 transmits the voltage applied to the lighting test signal line TEST_DATA to the data line in the second period t2.

The first period t1 and the second period t2 are periods not overlapping each other, and the first period t1 and the second period t2 may be set based on the number of pixel columns, the number of scan lines and a data storage speed.

First and second measurement data VDATA #1 and VDATA #2 are data measured on data lines connected to the first signal line 211 and the second signal line 212, respectively.

The first measurement data VDATA #1 is initialized by the first test circuit portion 120 during the first period t1 and maintained in an initial state until the second period t2 starts. Further, the first measurement data VDATA #1 is charged, by the second test circuit portion 140, to a voltage (e.g., about 6.3 V) which is applied to the lighting test signal line TEST_DATA, showing a graph of a parabolic line, from a point in time at which the second period t2 starts, and maintained at the voltage of about 6.3 V until the second period t2 ends.

The second measurement data VDATA #2 is initialized by the first test circuit portion 120 during the first period t1 and maintained in an initial state until the second period t2 starts. However, although the second measurement data VDATA #2 is charged by the second test circuit portion 140 from a point in time at which the second period t2 starts, the second measurement data VDATA #2 has a voltage lower than the voltage of about 6.3 V.

When damages occur in the non-display area NDA, which the second signal line 212 passes through, a resistance component of the second signal line 212 is increased and delay of the corresponding data line is thereby increased.

When damages occur in the non-display area NDA, the second measurement data VDATA #2 may not reach a target data voltage of about 6.3 V until the second period t2 ends. Accordingly, the second measurement data VDATA #2 has a voltage difference ΔV_screen with respect to the first measurement data VDATA #1, and a pixel (or a pixel column) connected to the second signal line 212 emits a light having a color other than black. Accordingly, whether the display panel is damaged or not may be effectively detected based on the light emission state of the pixel column connected to the second signal line 212.

In an exemplary embodiment, as described above, it is determined that a crack has occurred in the display panel when a pixel column emits light, but exemplary embodiments are not limited thereto. In an alternative exemplary embodiment, it may be determined that a crack has occurred in the display panel when a pixel column does not emit light.

FIGS. 5 and 6 are tables for explaining a method of detecting cracks in the display panel according to an exemplary embodiment. Particularly, FIGS. 5 and 6 are tables showing a light emission state of pixel columns connected to respective signal lines in a display panel that includes a crack detection circuit line including first, second, third and fourth signal lines at a non-display area. The first, second, third and fourth signal lines may be arranged in order from an inner portion to an outer portion of the non-display area.

In a case where a crack exists at an area where the first, second, third and fourth signal lines are disposed, a resistance component of each signal line increases and a pixel column connected to each corresponding signal line emits light. FIGS. 5 and 6 illustrate tables showing cases where pixel columns connected to respective signal lines emit light. In FIGS. 5 and 6, a case where a pixel column emits light is represented by "X," and a case where a pixel column does not emit light is represented by "O."

Referring to FIG. 5, in the case of Case 1, all of the pixel columns connected to the first, second, third and fourth signal lines do not emit light, and it may be determined that no crack has occurred (Ok). In addition, in the case of Cases 2 to 16, a pixel column connected to at least one of the first, second, third and fourth signal lines emits light, and it may be determined that a crack has occurred (Ng).

The method described above is the most strict method whereby it is determined that a crack has occurred even when one pixel column emits light. Such a determination method is a highly sensitive method of crack occurrence determination. Such a determination method may cause an error to determine that a crack has occurred even when no crack occurs, but one pixel column erroneously emits light due to particles or the like. In such a method, the accuracy of crack defect determination may be degraded.

Referring to FIG. 6, even though a pixel column connected to one signal line emits light, in the case where a pixel column connected to a signal line that is disposed more outwardly than the one signal line does not emit light, it is determined that the light emission is caused by signal line disconnection due to particles and no crack has occurred (Ok). For example, in the case of Case 3, a pixel column connected to the third signal line emits light while a pixel column connected to the fourth signal line which is disposed more outwardly than the third signal line does not emit light, it is determined that the crack defect has not occurred (Ok).

In an exemplary embodiment of the invention, the sensitivity of the crack occurrence determination may be variously changed according to the determination conditions, the number of used signal lines, and the like.

As set forth hereinabove, according to one or more exemplary embodiments, the display panel may improve both detection capability and accuracy of the crack defect detection circuit.

While the invention has been illustrated and described with reference to exemplary embodiments thereof, it will be apparent to those of ordinary skill in the art that various changes in form and detail may be formed thereto without departing from the spirit and scope of the invention.

What is claimed is:

1. A display panel comprising:

a substrate comprising a display area and a non-display area around the display area;

a plurality of scan lines on the substrate at the display area;

a plurality of data lines on the substrate at the display area and crossing the plurality of scan lines;

a plurality of pixels connected to the plurality of scan lines and the plurality of data lines; and a test circuit portion on the substrate at the non-display area, wherein the test circuit portion is connected to the plurality of data lines, wherein the test circuit portion comprises:

a lighting test signal line;

a second transistor having a gate electrode, a first electrode and a second electrode, the first electrode being connected to a second data line among the plurality of data lines; and a crack detection circuit line having first and second end portions, the first end portion being connected to the second electrode, the second end portion being connected to the lighting test signal line, wherein the crack detection circuit line comprises a plurality of signal lines each connected in series to a different respective second data line among the plurality of data lines in one-to-one correspondence through a plurality of a different respective second transistor, wherein each of the plurality of signal lines comprises:

a first portion extending from a corresponding second electrode of a second transistor along an edge of the display area; and a second portion extending from the first portion in a direction opposite to a direction in which the first portion extends, and connected to the lighting test signal line.

2. The display panel of claim 1, wherein the plurality of signal lines are disposed adjacent to each other.

3. The display panel of claim 1, wherein the plurality of signal lines is sequentially arranged from an inner portion of the substrate to an outer portion of the substrate.

4. The display panel of claim 1, wherein each of the plurality of signal lines is connected to at least one of the different data lines.

5. The display panel of claim 1, wherein the plurality of signal lines comprise:

first, second, third and fourth signal lines, wherein the first portion of each of the first, second, third and fourth signal lines extends in a clockwise direction along a first edge of the display area; and fifth, sixth, seventh and eighth signal lines, wherein the first portion of each of the fifth, sixth, seventh and eighth signal lines extends in a counterclockwise direction along a second edge of the display area.

6. The display panel of claim 5, wherein the first, second, third and fourth signal lines are disposed adjacent to the fifth, sixth, seventh and eighth signal lines at an area of the non-display area.

7. The display panel of claim 5, wherein the first, second, third and fourth signal lines are disposed alternately with the fifth, sixth, seventh and eighth signal lines in a zigzag manner at an area of the non-display area.

8. The display panel of claim 1, wherein the pixel comprises:

a first pixel which displays a red color;

a second pixel which displays a green color; and a third pixel which displays a blue color.

9. The display panel of claim 8, wherein each of the first, second and third pixels are provided in plural, and the data line comprises:

a first data line connected to a plurality of first pixels;

the second data line connected to a plurality of second pixels; and a third data line connected to a plurality of third pixels.

10. The display panel of claim 1, wherein a connecting point between the first portion of each signal line and the respective data line and a connecting point between the second portion of each signal line and the lighting test signal line are on a same side of the display panel each other.

11. The display panel of claim 1, wherein the test circuit portion further comprises a first transistor connected between the lighting test signal line and a first data line among the plurality of data lines; and a third transistor connected between the lighting test signal line and a third data line among the plurality of data lines.

12. A method of detecting a crack in a display panel comprising a display area, in which a pixel column connected to a data line are disposed, and a non-display area around the display area, the method comprising:

applying a lighting signal to the data line through a crack detection circuit line of a test circuit portion;

detecting whether or not the pixel column emits light; and determining whether or not a crack has occurred in the display panel based on a result of the detecting whether or not the pixel column emits light, wherein the test circuit portion comprises:

a lighting test signal line;

a second transistor having a gate electrode, a first electrode and a second electrode, the first electrode being connected to a second data line among the plurality of data lines, the crack detection circuit line having first and second end portions, the first end portion being connected to the second electrode, the second end portion being connected to the lighting test signal line, wherein the crack detection circuit line comprises a plurality of signal lines each connected in series to a different respective second data line among the plurality of data lines in one-to-one correspondence through a plurality of a different respective second transistor, wherein each of the plurality of signal lines comprises, a first portion extending from a corresponding second electrode of a second transistor along an edge of the display area; and a second portion extending from the first portion in a direction opposite to a direction in which the first portion extends.

13. The method of claim 12, wherein the plurality of signal lines are sequentially arranged from an inner portion of a substrate to an outer portion of the substrate.

14. The method of claim 13, wherein the determining whether or not the crack has occurred comprises determining that the crack has occurred when at least one of the pixel columns emits light.

15. The method of claim 14, wherein the determining whether or not the crack has occurred comprises determining that no crack has occurred when:

a pixel column of the pixel columns emits light;

another pixel column of the pixel columns does not emit light; and a signal line connected to the another pixel column, which does not emit light, is disposed more outwardly than a signal line connected to the pixel column which emits light.

16. The method of claim 13, wherein the determining whether or not the crack has occurred comprises determining that the crack has occurred when at least one of the pixel columns does not emit light.

17. The method of claim 16, wherein the determining whether or not the crack has occurred comprises determining that no crack has occurred when:

a pixel column of the pixel columns emits light;

another pixel column of the pixel columns does not emit light; and a signal line connected to the pixel column, which emits light, is disposed more outwardly than a signal line connected to the another pixel column which does not emit light.

18. The display panel of claim 12, wherein a lighting signal of the lighting test signal line is not applied to the second transistor when the crack has occurred, and wherein the crack detection circuit is disconnected when the crack has occurred.

* * * * *